United States Patent [19]

Gerry

[11] 4,191,912

[45] Mar. 4, 1980

[54] DISTRIBUTORLESS IGNITION SYSTEM

[76] Inventor: Martin E. Gerry, 13452 Winthrope St., Santa Ana, Calif. 92705

[21] Appl. No.: 962,754

[22] Filed: Dec. 14, 1978

[51] Int. Cl.[2] ..... F02P 9/00

[52] U.S. Cl. ..... 315/209 R; 315/153; 315/209 T; 361/156; 361/256; 123/148 E

[58] Field of Search ..... 123/148 E, 148 B; 361/256, 156; 315/209 R, 209 T, 209 CD, 209 M, 153

[56] References Cited

U.S. PATENT DOCUMENTS

| | | | |
|---|---|---|---|
| 3,993,035 | 11/1976 | Gerry | 123/148 E |
| 4,122,815 | 10/1978 | Gerry | 123/148 E |
| 4,140,946 | 2/1979 | Gerry | 315/209 R |
| 4,144,476 | 3/1979 | Gerry | 315/209 R |

*Primary Examiner*—Alfred E. Smith
*Assistant Examiner*—Charles F. Roberts

[57] ABSTRACT

A distributorless ignition system has an alternating current power source for providing power to fire the igniters. The alternating current power source is coupled through a capacitor to a plurality of ignition transformers, one transformer for each igniter. Each transformer has an electronic switch in its primary winding circuit initiated by independent logic means for each switch. A timer, driven by the engine, triggers one logic circuit at a time so that only one electronic switch and consequently one igniter is fired at such one time, maintaining the other logic circuits and electronic switches quiescent during such firing. The system has short lengths of high tension wires connecting each ignition transformer secondary winding to its respective igniter. Such system is devoid of any sparking distributor switch and consequently devoid of long lengths of high tension wires connecting the distributor to the igniters, thereby avoiding substantial amounts of electromagnetic radiation emanating from the long lengths of high tension wires. Such system produces high energy that serves to burn substantially all the fuel injected into the engine combustion compartment and consequently reduces contaminents expelled from the exhaust system.

19 Claims, 9 Drawing Figures

EQUIVALENT CIRCUIT, IN WHICH:

$i = i_0 + i_1$ $V_0 = 300$ VOLTS, peak-to-peak $V_1 = 12$ VOLTS DC $\alpha = 20$ $k = 10^{-4}$ SECONDS $\tau = 10^{-3}$ SECONDS $R_0 = 0.8$ OHMS $R_1 = 2.6$ OHMS $R = R_0 + R_1 = 3.4$ OHMS $L_0 = 10^{-2}$ HENRIES $L_1 = 10^{-2}$ HENRIES $L = L_0 + L_1 = 2 \times 10^{-2}$ HENRIES The integro-differential equations for the equivalent circuit are:

$$v_0(t) = L\frac{di_0}{dt} + Ri_0 + \frac{1}{C}\int i_0\,dt \quad (1)$$

$$v_1(t) = L\frac{di_1}{dt} + Ri_1 + \frac{1}{C}\int i_1\,dt \quad (2)$$

where $v_0(t) = V_0\left[u(t) - \sum_{n=1}^{\infty}(-1)^n u(t-2nk)\right]$ (3)

$$v_1(t) = \alpha V_1\left[u(t) - u(t-\tau)\right] \quad (4)$$

The transient solution of equation (1) is:

$$i_0 = \sqrt{\frac{C}{L}}V_0 e^{-\frac{R}{2L}t}\left\{\sin\frac{t}{\sqrt{LC}} - 2e^{\frac{kR}{L}}\sin\frac{(t-2k)}{\sqrt{LC}} + 2e^{\frac{2kR}{L}}\sin\frac{(t-4k)}{\sqrt{LC}}\right\} \quad (5)$$

The transient solution of equation (2) is:

$$i_1 = \alpha V_1\sqrt{\frac{C}{L}}e^{-\frac{R}{2L}t}\left\{\sin\frac{t}{\sqrt{LC}} - e^{\frac{\tau R}{2L}}\sin\frac{(t-\tau)}{\sqrt{LC}}\right\} \quad (6)$$

The total primary circuit current is:

$$i = i_0 + i_1 \quad (7)$$

The induced primary voltage due to (5) is:

$$e_0 = -\frac{L_1}{L}V_0 e^{-\frac{R}{2L}t}\left\{\cos\frac{t}{\sqrt{LC}} - 2e^{\frac{kR}{L}}\cos\frac{(t-2k)}{\sqrt{LC}} + 2e^{\frac{2kR}{L}}\cos\frac{(t-4k)}{\sqrt{LC}}\right\} \quad (8)$$

The voltage due to (6) is:

$$e_1 = -\frac{L_1}{L}\alpha V_1 e^{-\frac{R}{2L}t}\left\{\cos\frac{t}{\sqrt{LC}} - e^{\frac{\tau R}{2L}}\cos\frac{(t-\tau)}{\sqrt{LC}}\right\} \quad (9)$$

The total primary induced voltage is:

$$e = e_0 + e_1 \quad (10)$$

P(pri. ckt. instantaneous power) $= ie = (7.1)(1130) = 8023$ watts (11)

$\mathcal{E}$(pri. ckt. energy) $= P\pm T^2 = (8023)(.833\times10^{-3})(.25) = 1.67$ watt-sec. (12)

$\mathcal{E}$(igniter firing energy) $= \eta\mathcal{E}_{PRI} = (.9)(1.67) = 1.5$ watt-sec. (13)

$$N = \frac{\mathcal{E}_{igniter}}{\mathcal{E}_{KETTERING}} = \frac{1.5}{0.936\times10^{-2}} = 160 \quad (14)$$

FIG. 6

DISTRIBUTORLESS IGNITION SYSTEM

INCROPORATION BY REFERENCE

U.S. Pat. No. 4,122,815, issued Oct. 31, 1978 to same applicant, is incorporated by reference herein as though fully set forth, for the timing method disclosed therein.

BACKGROUND OF THE INVENTION

This invention is in the field of ignition systems, and more particularly in the field of alternating current systems which avoid the use of a high voltage arcing distributor switch.

The prior art, such as U.S. Pat. No. 3,993,035, have independent ignition transformers for each igniter, but also include a high voltage distributor which necessarily has relatively long high tension leads that radiate electromagnetic fields causing radio and high frequency communication system interference.

Such prior art systems additionally suffer from insufficient energy being fed to each igniter and consequently from incomplete fuel combustion, fuel waste and production of atmospheric contaminents due to lack of complete fuel combustion.

SUMMARY OF THE INVENTION

It is an objective of this invention to provide an ignition system which will be devoid of any arcing distributor switches.

It is another objective of this invention to provide an ignition system which will have relative short high tension leads so as to minimize electromagnetic radiation therefrom and avoid interference with communication systems.

It is still another objective of this invention to utilize alternating current as the basic power feeding such ignition system in order to enable large quantities of energy to be fed to each igniter so that the fuel in the engine will be more completely combusted and exhaust contaminents reduced.

Accordingly, a distributorless ignition system is provided having a relatively high frequency alternating current power source, wherein such system is devoid of any arcing distributor switch. A single capacitor in series with the power source output provides means for transferring large quantities of AC current from the power source to the load consisting of a plurality of ignition transformers. Each of the transformers has an electronic switch in its primary circuit and each such switch is coupled to its own independent logic circuit which initiates the switch, one switch at any one time so that only one igniter will be fired during any one firing period. The logic circuits are sequentially triggered by a timer which determines the period of igniter firing, during which period AC power will be fed to the particular igniter. Such AC power is fed through the particular one electronic switch that had been initiated by the particular logic circuit, the other electronic switches being maintained non-conductive during such firing by the system logic.

Inasmuch as there are as many igniters as there are ignition transformers, each high voltage secondary winding of an ignition transformer is connected to an independent igniter. This makes possible short high tension leads to the igniters which minimize electromagnetic radiation during igniter firing mode.

The electronic switches are enabled by the peak excursions of the AC current and voltage waves instead of being hard-wire connected to a DC power source, and consequently such electronic switches may be directly in the output load line to assist in inhibiting residual energy stored in the output transformer of the AC power source, so as to properly control the duration of any firing period and avoid pre-ignition and hence premature firing of the next in sequence igniter to fire.

The absence of the arcing distributor makes possible locating the ignition transformers close to each respective igniter so that high voltage lead connections will be short and electromagnetic fields radiated from such leads, minimal.

The high energy capable of being delivered to each igniter by virtue of delivering current and voltage over the entire firing period, will enable the combusion of the fuel in the engine more effectively and completely, provide high engine performance, reduce the quantity of fuel consumed per mile of driving and reduce atmospheric contaminents resulting from incomplete combustion of fuel as in an engine utilizing a conventional ignition system.

BRIEF DESCRIPTION OF THE DRAWINGS

FIG. 6 shows in tabular form the various equations and mathematical solutions utilizing the equivalent circuit of FIG. 5 to obtain such equations and solutions.

DETAILED DESCRIPTION

Figure 1:
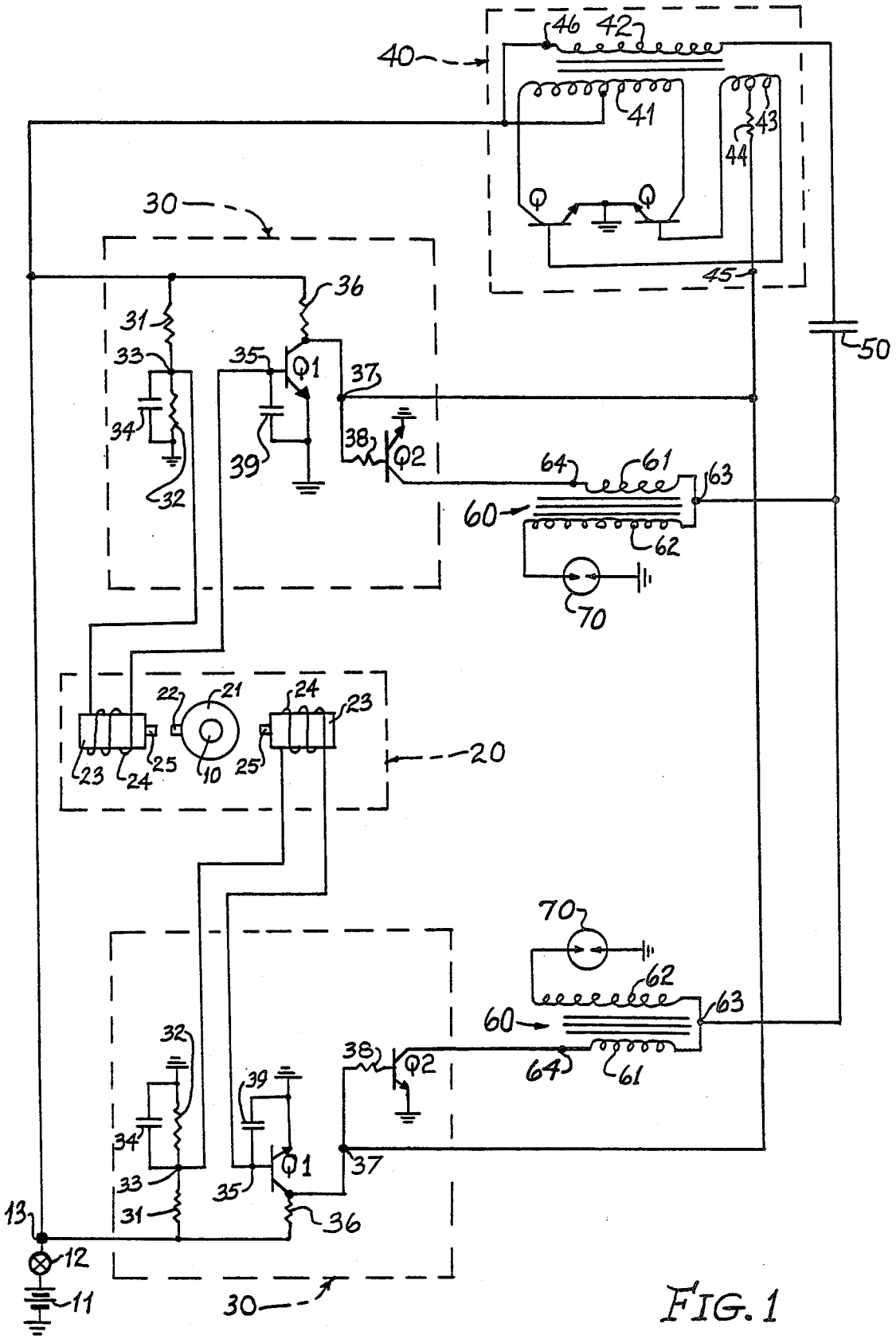
FIG. 1 is a schematic diagram of an ignition system according to this invention.

Referring to FIG. 1, a high voltage, high current and consequently a high energy ignition system comprises an alternating current power source, a capacitor and a plurality of ignition transformers. This system features an energy inhibit switch, electronically controlled by a logic circuit, in each primary winding circuit of each ignition transformer, which logic circuit also substantially simultaneously turns on the alternating current source during the operative period of each firing cucle of the system and turns off the alternating current power source and the energy inhibit switch during the non-firing portions or quiescent periods of the system. In FIG. 1, such logic circuit is triggered by a magnetic pulse timer.

In this specification, the conventional ground symbol is shown signifying either negative battery potential of battery 11, DC electrical return path or AC electrical return path, and hence such return paths and negative battery potential need not be referred to hereinbelow in explaining operation of the system. The system has a plural number of of logic circuits 30 and a like plural number of magnetic sensors within timer 20 as well as a like number of ignition transformers 60, one sensor, logic circuit and ignition transformer for firing one igniter. It should only be necessary to discuss one such set of components as the other sets of components are identical in structure and function.

Accordingly, battery 11, generally of the 12 volt type, provides DC power to the system through ignition switch 13 to make available the positive potential of such DC power source at junction 13, and to feed DC power directly to logic circuit 30 and to alternating current power source 40.

Alternating current power source 40 is shown as a transistor type rectangular wave generator, but it is to be understood that any alternating current source providing for example a saw tooth waveform, a triangular waveform or a sinusoidal waveform may be effectively used to effect this invention, in the circuits of FIG. 1 or in the circuits shown in other figures of this specification. It is also pointed out that source 40 will provide sinusoidal waveforms if the transistors therein are not driven to cause saturation of the transformer core of source 40.

A magnetic pulse timer 20 consists of reluctance wheel 21 having rib 22 at the wheel periphery, wherein wheel 21 and rib 22 are made of a suitable magnetic material and wherein such wheel is driven by distributor shaft 10 which is common to any automotive engine. Such timer employs permanent magnet 23 having a sensor winding 24 thereon. Magnet 23 has pole piece 25 at one end, so that when shaft 10 is driven by the engine, rib 22 will interrupt magnetic flux lines between such rib 22 and the pole piece 25, and induce a voltage in winding 24. The magnetic pulse timer with a single magnetic sensor and a reluctor wheel having a plural number of ribs is conventional in the automotive field.

The magnetic timer may be designed with respect to the orientation of the north and south magnetic poles of magnet 23 as well as with respect to the direction of the turns of wire comprising winding 24, so as to provide either a leading negative or leading positive going pulse as an output of winding 24 when rib 22 is driven past pole piece 25. The leading negative pulse design was adopted herein since this is conventional in the automotive industry, and accordingly the components of logic circuit 30 are tailored to recognize such timer pulse. The voltage output from each such winding 24 in the form of such pulse is fed to its respective logic circuit 30.

Logic circuit 30 comprises a voltage divider consisting of resistors 31 and 32 having a capacitor 34 shunting resistor 32. Such voltage divider is connected to DC power at 13, and resistors 31 and 32 are chosen so that a positive DC potential of about 1.2 volts appears at junction 33 to which one end of winding 24 is connected. Such logic circuits herein utilize an NPN type transistor switch Q1 each, the collector of which is connected through resistor 36 to junction 13 so as to provide DC power to switch Q1. The other side of winding 24 is connected to the base of Q1, and such base has capacitor 39 connected between it and the emitter of Q1, which emitter is at ground potential. The function of capacitors 34 and 39 is to filter out and reject AC components riding on the gate pulse and initiated by winding 24 due to switching action of timer 20 when shaft 10 drives reluctor wheel 21. If desired, an additional capacitor, not shown, may be connected between junction 35 and the collector of Q1 for effecting additional rejection of such timer generated AC components. However, in this system, it may be an advantage to pass such timer generated AC components as they serve to modulate the gate or firing pulse at junction 37, thereby adding more firing energy by adding to the alternating current output from source 40 and by adding such components through switch Q2 to the firing current in each of transformers 60. In such latter instance, capacitor 39 may be omitted. It is of course to be noted that it would be a simple matter to utilize a PNP type as Q1 with appropriate changes in the rest of the circuit comprising logic circuit 30. Hence, junction 37 is the point in the system which will change in its potential to enable switching control of AC source 40 and the energy inhibit switch Q2, providing a firing gate at such junction 37.

Operatively, when shaft 10 is not being driven by the engine, no voltage is provided by winding 24 across junctions 33 and 35. Under such condition, the base of Q1 will be at a positive potential, sufficient to maintain Q1 in its ON mode, so that junction 37 will be at ground potential. In this case, DC current will flow through winding 24 to maintain the base of Q1 at a positive potential, thereby maintaining Q1 in its ON state, in which case the point at which resistor 36 is connected to the collector of Q1 and junction 37, is at ground potential thus causing the base of Q2 to be at ground potential as well as the bases of both Q's of source 40, thereby preventing source 40 from oscillating and inhibiting Q2 from conducting.

When shaft 10 is driven, a pulse having a negative excursion is induced in winding 24 at the time when rib 22 is driven past one of pole pieces 25, providing such negative going pulse to the base of Q1 to 35 and turning off Q1, thereby causing junction point 37 to be at positive potential, and under these conditions, turning on oscillator 40 by virtue of positive DC being applied to the bases of the Q's thereof, as well as by turning on switch Q2 by virtue of such same DC positive bias being applied to its base. The manner in which Q2 obtains its collector enabling voltage will be discussed below. The following table shows the switching logic applicable to the circuits of FIG. 1:

| Shaft 10 | Potential of Junction 35 | State of Q1 | Potential of Junction 37 | State of Q's | State of Q2 |
|---|---|---|---|---|---|
| at standstill | positive | ON | ground | OFF | OFF |
| being driven | negative | OFF | positive | ON | ON |

Since Q1 is generally a silicon device, it requires a base potential between 0.06 to 0.8 volts to maintain it in conductive state, and hence the +1.2 volts provided between junction 33 and ground, even considering the voltage drop in winding 24, will still maintain adequate voltage level at 35 within the stated limits for minimum sustaining voltage, so that Q1 will be in the ON state when shaft 10 is at standstill as well as when shaft 10 is driven but when rib 22 is not opposite pole piece 25. In the ON state of Q1, junction 37 will be at ground potential thereby biasing the base of Q2 and the bases of the Q's to cause them to be non-conductive, or in their OFF states.

The divider network consisting of resistors 31 and 32 is chosen so that the voltage at junction 33 will be 1/10 th the battery voltage. Hence, if the battery or power source charging such battery is defective so that only 8 volts is provided by the battery, there will still be 0.8 volts at junction 33 which will be sufficient to maintain switching action of Q1 and operate logic circuit 30. Additionally, the manner in which winding 24 is connected to logic circuit 30 and the large capacitance of capacitor 34, permitted at its shown location, act to provide a stable source of input voltage to winding 24, and thereby results in a very reliable switching logic circuit.

When shaft 10 is driven and rib 22 is driven past pole piece 25, a negative pulse will be induced in winding 24 which is between 1.5 and 2 volts in amplitude, thereby overcoming the positive bias of the base of Q1 and driving such base negative thereby cutting off current conduction between the collector and emitter of Q1, so that Q1 in switching to its OFF state, will cause junction 37 to be raised to a positive potential so as to turn on the Q's of power source 40 and switch Q2 to its ON state. The manner in which the Q's of source 40 turn on and off at a particular oscillating frequency or repetition rate is well known in the art and need not be discussed.

When power source 40 is turned on during each firing cycle, that is, each time rib 22 is driven past one of pole pieces 25, such source stays on for the duration when any portion of rib 22 is opposite any portion of pole piece 25, providing the firing gate or firing period at 37 to enable firing of an igniter in an engine, not shown. Power source 40 will keep on generating rectangular waves during such firing gate by virtue of Q1 being in its OFF state and consequently Q2 and the Q's being biased so as to cause Q2 to conduct during such firing gate period and the Q's to oscillate during such firing gate period. By virtue of rotation of wheel 21, when pole piece 25 is opposite the periphery of wheel 21 at locations other than opposite rib 22, no firing gate is provided because there is absent the required negative going pulse as input at 35, so that Q1 is again biased sufficiently positive so as to switch it to its ON state thereby turning off Q2 and both Q's.

Power source 40 has as an integral part thereof a coupling output transformer the design of which controls the frequency of repetition rate of source 40. In this instance, a power source providing a 5 kilocycle rectangular repetition rate was utilized experimentally, the results of which will be discussed below. The output transformer has a center tapped primary winding 41 the ends of such winding being connected each respectively to the collectors of each of the Q's, and the emitters of these Q's being at ground potential in a common emitter configuration. The oscillator circuit utilizes Q's which are of the NPN type and preferably of the Darlington circuit configuration since such Darlington circuits will have inherently high current amplification characteristics which will provide high induced voltage levels in primary 41. Feedback winding 43 is also center tapped and the ends thereof are respectively connected, one to each base of transistors Q, so as to provide magnetic coupling between windings 43 and 41 and a feedback voltage to maintain oscillation of power source 40. The center tap of winding 43 has bias resistor 44 connected thereto to set the bias current to the proper level for enabling source 40 to be pulsed ON each time junction 37 and consequently terminal 45 is at positive potential, and simultaneously to provide such positive pulse to the base of Q2 so as to turn on Q2. When junction 37 is at ground potential transistors Q1 and Q2 will be in their OFF states.

It is pointed out that NPN Darlington transistors type 2N6284 made by Motorola were used experimentally as the Q's with excellent performance resulting. It is also to be noted that PNP Darlington transistors of type 2N6287 made by Motorola give similar excellent results. However, with the PNP type transistors, circuit 40 was modified so that the collectors were at negative battery or ground potential, and the emitters were at positive DC potential, and the logic circuit had to be modified to provide the ON and OFF modes discussed above which are compatible with required potentials for the bases of the PNP transistors.

The transformer of source 40 has a secondary winding 42 which provides energy to an external load, such as capacitor 50 and each primary winding 61 of transformer 60, as well as being an enabling means to initiate conduction in Q2 by providing thereto a series of positive potentials by virtue of the positive peaks of the waveform generated by circuit 40 during each firing cycle. It is to be noted that DC positive potential to the Q's is provided by virtue of the center tap of winding 41 being connected to junction 13. It is also to be noted that point 46 of winding 42 is connected to junction 13. It should also be noted that winding 42 at junction point 46 could have been connected to ground, if desired.

Capacitor 50 is provided and coupled to winding 42 at one side thereof, the other side of the capacitor being connected to common terminals 63 of each ignition transformer 60. Here too, such other side of capacitor 50 could have been connected to terminals 64 of transformers 60, in which case each terminal 63 would have been connected to its respective collector of Q2.

Capacitor 50 is the means for enabling current, and hence power, to be transferred from primary circuit winding 41 through secondary 42 to the load, in this case to transformer primary 61. Without such capacitor the current in primary 61 would not be present in sufficient quantity, and consequently the voltage across primary 61 would be inadequate. Considering that the circuit comprising winding 42, primary 61 and the reactance reflected by secondary 62 when under igniter firing, which is inductive, the capacitive reactance presented by capacitor 50 enables compensation of these inductive reactances resulting in an increased primary winding current in transformer primary 61. The resonance principle cannot be used in its entirety to explain the phenomena involving the capacitor's compensation function, since resonance generally involves a single frequency and, unlike here, unique reactance values, and in this system multiple frequencies are generated by power source 40 which involve a like number of different reactances. In any event, such capacitor 50 is selected by trying various values of capacitors until the current in winding 61 is a maximum. Such current may be conveniently measured and observed by using a one-ohm high power resistor in the primary winding circuit, say between junction 64 and the collector of Q2, and measuring the voltage across such resistor by means of an accurately calibrated high frequency osilloscope.

Typical capacitor values will be in the order of between 0.2 to 1.0 microfarads.

Ignition transformer 60 was selected to have a turns ratio of 100, somewhat higher than stock automobile transformer turns ratios, since this will provide a greater voltage induced in secondary 62 and transferred to an igniter connected thereto.

Switch Q2 has as its principal component, a high power, high voltage rated and high current rated power transistor. Such transistor may typically be selected from the group of type 2N6251 made by RCA, type 2N6547 made by Motorola, type FT 359 made by Fairchild, or any of a series of Darlington type transistors made by Motorola of the MJ series, such as MJ 10009.

It is important not only to select a transistor for this purpose which will have a high collector current rating, but such transistor should also be able to withstand the high collector to emitter voltage of the system at that particular Q2 location in the circuit. Bias resistor 38 of switch Q2 is selected of sufficient ohmic value to limit the base current to a safe level within the rating limits of that transistor, and a resistor value is used which permits just enough base current to flow so as to enable Q2 to perform its switching function rapidly. Providing too much base current in Q2 by having too low an ohmic value for resistor 38 will slow down switching time of Q2 from its ON to its OFF state, and will tend to defeat the major purpose and use of switch Q2.

In a high power system such as illustrated, which approaches 10 kilowatts of instantaneous power, separation of firing waveforms will not be possible without Q2 being in circuit, by virtue of the fact that energy generated by source 40 and residual in its transformer windings, will tend to cause current to continue to flow after the Q's of circuit 40 are biased to their OFF states. Consequently, the Q2 switch also acts to assure rapid deprivation of energy feed to transformer 60 by inhibiting such residual energy from transferring to such transformer 60 at the end of each igniter firing cycle. Such is accomplished by interruplting such primary current flow by rapidly turning off Q2 at the same time as the Q's of source 40 are turned off. The penalty for not having such switch as Q2 in a high power unit, in addition to its normal function being lost in not enabling only one ignition transformer at a time, is that pre-ignition firing will occur since the next-in-sequence igniter would be prematurely ignited by virtue of the current and voltage waveforms being continued beyond the required firing period.

A cursory examination of Q2 circuit, would seem to appear to indicate Q2 inoperability in view of no hard wire collector connection to a DC power source. However, as was previously mentioned, Q2 is enabled, that is the equivalent of such DC power is provided to the collector by the positive potential going peak excursions of the waveforms provided by AC source 40. The rate of such excursions, say in the order of between 2.5 and 10 kilocycles per second, though a 5 kilocycle per second rate was actually used, serves to maintain Q2 in its conductive mode throughout each and every igniter fire cycle.

A further benefit may be derived when a Darlington circuit type transistor such as an MJ 10009, MJ 10001 or an MJ 10005 by Motorola is chosen as the Q2 transistor. Such Darlington circuit is inherently a current amplifier, so that the current produced by the firing gate to trigger the base of Q2 to its ON state is amplified by Q2 and adds additional current to the current quantity in the primary winding. Such current injection feature is discussed below in conjunction with the computations made on this system, but it should be noted that since the current increases, the voltage across the primary 61 will be increased by virtue of the increased current flow.

Another feature of the inventive system, including of course the variations of such system as discussed below in conjunction with the other system figures herein, is the quiescent state of power source 40 for about 25% of the system on-time. Inasmuch as Darlington circuits are used for the Q's, high AC currents circulate in their collector circuits in the ON modes of such Q's. Such high currents will contribute to high induced voltages in winding 42, and would normally require large heat sinks to dissipate the heat generated thereby. Since in this power generator, each of the Q's is in its ON state only half the time of each cyclic excursion of the AC current produced therein, and since each igniter firing period is less than one-half its non-firing period in time duration, triggering bias winding 43 in order to turn the Q's on and off, will permit the transistors to be maintained at relatively low operating temperatures because each of the Q's will in effect have a duty cycle of less than 25%. Further, switching such power source 40 to its ON mode will create a transient voltage at the beginning of each firing cycle which will be greater in amplitude than the voltage normally deliverable by such source 40, absent this type of switching.

Figure 2:
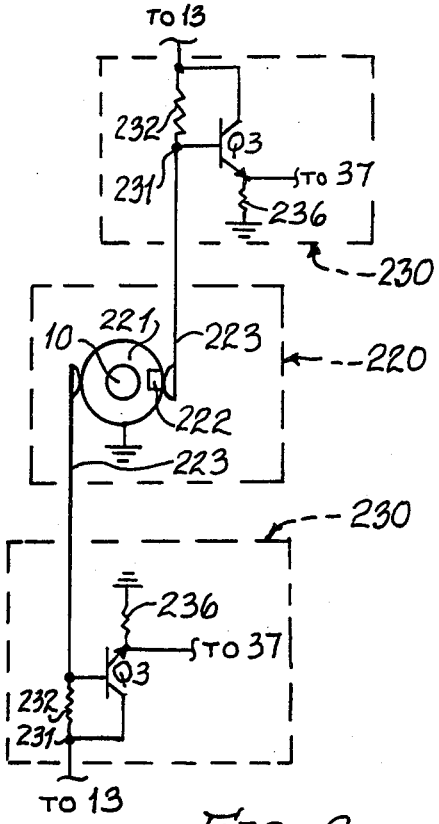
FIG. 2 is a partial schematic diagram of the ignition system substituting a contactor and disk timer and logic circuits therefor for the magnetic pulse timer and its logic circuits of FIG. 1.

Referring to FIG. 2, the system illustrated is identical to the system as discussed in connection with FIG. 1 except that trigger means 20 is replaced by trigger means 220 and logic circuit 30 is replaced by logic circuit 230, in each case.

Logic circuit 230 provides the same function as logic circuit 30 described in connection with FIG. 1, but is of different structure.

Trigger means 220 employs an electrically conductive disk 221 attached to and driven by shaft 10 of the engine. The shaft being at ground potential will electrically ground disck 221. Disk 221 has an electrically insulative member 222 at the periphery of the disk within the disk confines. Contactors 223 are connected to junctions 231, one to each junction respectively, and are in cooperation with the periphery of the disk. Consequently, when insulative member 222 is in cooperation with one of contactors 223, the base of the Q3 to which such contactor is connected being at the same potential as junction 231, is biased with a DC positive potential and Q3 conducts thereby providing a positive potential at its emitter and consequently providing such positive bias to junctions 37 and 45 thereby turning on Q2 and the Q's to perform the functions as hereinabove described in connection with FIG. 1. When contactor 223 is in cooperation with the metallic or conductive portion of disk 221, junction 231 is at ground potential, Q3 does not conduct, and junctions 37 and 45 are at ground potential, thereby turning off Q2 and the Q's. The following logic is applicable to show the functions performed by the FIG. 2 configuration:

| Contactor 223 in Cooperation With | Potential at Junction 231 | State of Q3 | Potential at Q3 Emitter | State of Q's | State of Q2 |
|---|---|---|---|---|---|
| metallic portion of disk 221 | ground | OFF | ground | OFF | OFF |

-continued

| Contactor 223 in Cooperation With | Potential at Junction 231 | State of Q3 | Potential at Q3 Emitter | State of Q's | State of Q2 |
|---|---|---|---|---|---|
| member 222 | positive | ON | positive | ON | ON |

Figure 3:
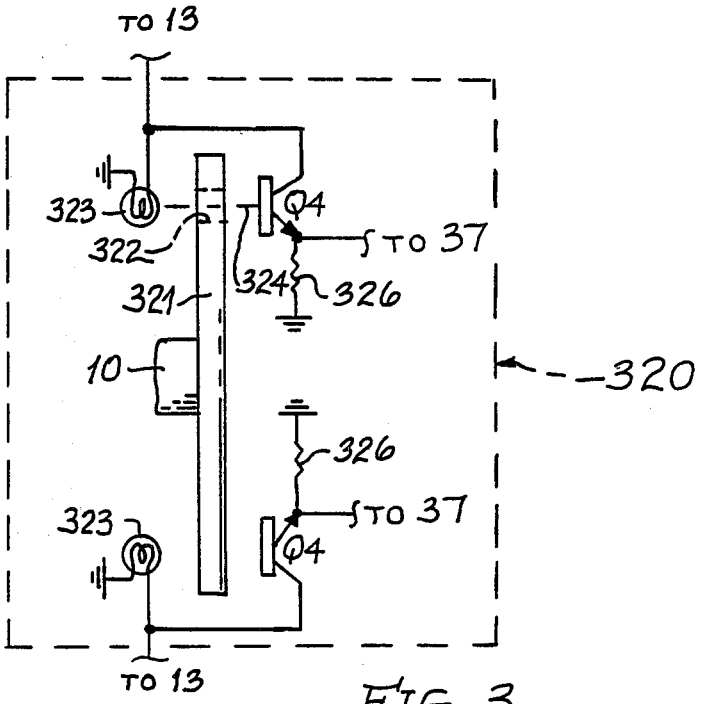
FIG. 3 is a partial schematic diagram of the ignition system substituting an optical timer and logic circuits therefor for the magnetic pulse timer and its logic circuits of FIG. 1.

Referring to FIG. 3, the system illustrated is identical to the system as discussed in connection with FIG. 1, except that trigger means 20 and logic circuits 30 are replaced by an optical trigger logic circuit 320.

Circuit 320 comprises a disk 321 driven by distributor shaft 10. Disk 321 has an aperture 322 in the disk at the periphery thereof. Powered illumination means 323 is provided at one face of disk 321 for optically intermittently illuminating the bases of optically sensitive transistors Q4 by means of light beams such as 322 passing through such apertures to turn Q4 on, each time light beam 324 impinges on the base of Q4 and thereby causes the emitter of Q4 to rise to a positive DC potential by virtue of collector current flowing in Q4. When light beam 324 is blocked by the opaque portion of disk 321, Q4 is off and no collector current flows in Q4, and consequently the potential at either end of resistor 326 is the same, namely ground potential. Hence, when Q4 is in its OFF state, junctions 37 and 45 will be at ground potential maintaining Q2 and the Q's in their OFF states. On the other hand, when Q4 is in its ON state, junctions 37 and 45 will be at positive DC maintaining Q2 in its ON state and the Q's in their oscillatory modes. The following logic table is applicable to show the functions of the FIG. 3 configuration:

| Light Beam 324 | State of Q4 | Potential at Q4 Emitter | State of Q's | State of Q2 |
|---|---|---|---|---|
| blocked by disk 321 | OFF | ground | OFF | OFF |
| passes through aperture 322 | ON | positive | ON | ON |

Figure 4:
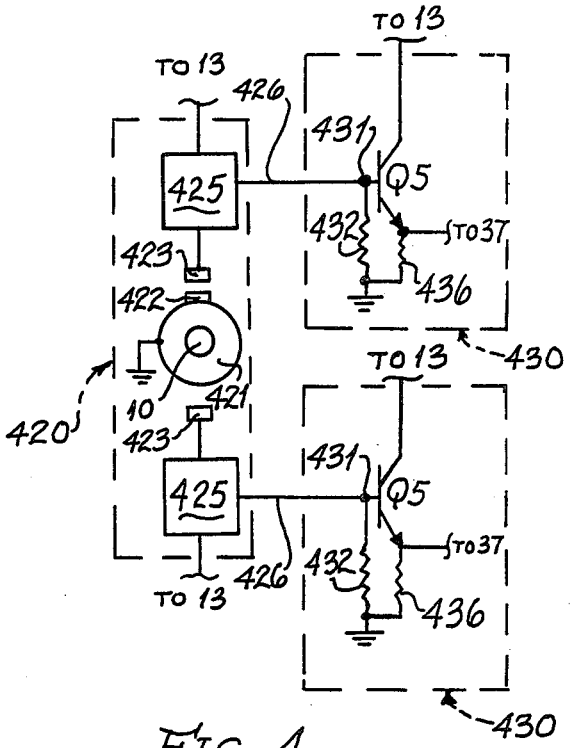
FIG. 4 is a partial schematic diagram of the ignition system substituting a modulated oscillator timer and its logic circuits for the magnetic pulse timer and its logic circuits of FIG. 1.

Referring to FIG. 4, the system illustrated is identical to the system as discussed in connection with FIG. 1, except that trigger means 20 is replaced by trigger means 420, and logic circuit 30 is replaced by logic circuit 430.

Trigger means 420 employs an angular modulated oscillator wherein oscillator 425 is modulated by virtue of a variable capacitor being driven by distributor shaft 10. Such capacitor comprises a rotatable plate 421 having a protrusion 422 at the periphery of plate 421 and having a plural number of fixed plates 423 connected each to an oscillator 425. Plate 421 is at ground potential since it is attached to shaft 10 which is grounded. Oscillator 425 provides a positive going signal output imposed upon junction 431 of logic circuit 430 whenever protrusion 422 is driven past fixed plate 423. More details concerning this modulation method is available in U.S. Pat. No. 4,122,815, issued Oct. 31, 1978 which was incorporated by reference herein.

Logic circuit 430 has a bias resistor 432 connected between the base of transistor Q5 at 431 and ground, so as to maintain the base at ground potential until such time as a positive going signal from oscillator 425 drives the base sufficiently positive to cause base current to flow and hence to cause collector current to flow and Q5 to conduct.

The emitter of Q5 has resistor 436 connected between it and ground, so that when junction 431 is at ground potential and no collector current flows, the Q5 emitter and junctions 37 and 45 will be at ground potential thereby maintaining Q2 and the Q's in their OFF states. When a positive going signal from oscillator 425 appears at junction 431 due to the oscillator being angularly modulated, the base of Q5 will be driven positive and base current will flow to cause Q5 to switch to its ON state, thereby raising the Q5 emitter and junctions 37 and 45 to a positive DC potential and causing Q2 to be switched to its ON state and the Q's to oscillate. The following table expresses the logic performed by the FIG. 4 configuration:

| Oscillator 425 | Potential at Junction 431 | State of Q5 | Potential at Q5 Emitter | State of Q's | State of Q2 |
|---|---|---|---|---|---|
| not modulated | ground | OFF | ground | OFF | OFF |
| angularly modulated | positive | ON | positive | ON | ON |

Figure 5:
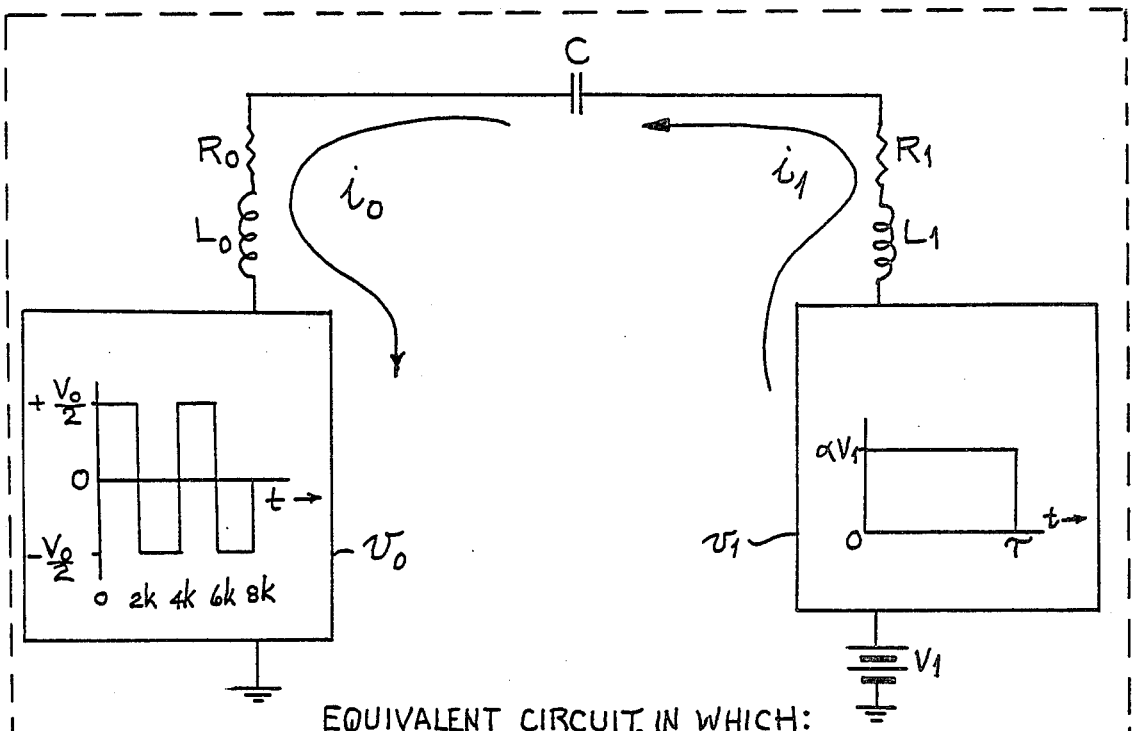
FIG. 5 is a schematic diagram of an equivalent circuit which represents any of FIGS. 1, 2, 3 or 4 and which includes a listing of parameters and typical values used in connection with such equivalent circuit to enable system performance computations to be made.

Referring to FIGS. 5, 6, 7 and 8, the equivalent circuit for each of configuration in FIGS. 1, 2, 3 and 4, may be represented by FIG. 5 for computation purposes and theoretical analysis. The parameters of such equivalent circuit are utilized in the equations listed in FIG. 6 in symbolic terms. The numerical values of the parameters as used in the computations are tabulated within FIG. 5. Such numerical values when substituted for the symbolic terms enables the solutions for current and voltage components to be graphed in FIGS. 7 and 8 respectively.

Accordingly, $v_o$ is the rectangular wave voltage function generated by power source 40, in effect in series with the inductors, resistors and capacitor of the equivalent circuit. Voltage $V_1$, constituting the voltage of battery 11, also feeds the circuit from its end, opposite to the end showing the AC power source connection. Suth method of drawing the equivalent circuit is for convenience and clarity, and it really makes no difference in a series circuit where the voltage sources are located in order to develop the equations for such circuit.

Voltage $v_1$, represented by a single pulse rectangular wave having a duration period of $\tau$, is shown in effect in series with the other circuit components, and such pulse $v_1$ represents the firing gate or igniter firing period provided by the several logic circuits at junctions 37 and 45 in any of the configurations of FIGS. 1–4.

The following table shows the correlation of the symbolic terms used in FIG. 5 and the computations shwon in FIG. 6 with the components as identified in FIGS. 1–4:

| | Symbol in FIG. 5 | Corresponding Number of FIGS. 1–3 |
|---|---|---|
| $L_o$ | effective inductance of AC power source | 42 includes reflected inductance of 41 |
| $R_o$ | DC series resistance of $L_o$ | not shown |
| $L_1$ | effective inductance of ignition transformer at primary | 61 includes reflected inductance of secondary 62 |
| $R_1$ | DC series resistance of $L_1$ | not shown |
| C | capacitor | 50 |
| $v_o$ | voltage output of AC source | not shown |

-continued

| Symbol in FIG. 5 | Corresponding Number of FIGS. 1-3 |
|---|---|
| $v_1$ firing gate voltage | not shown, but appears at 37 and 45 |

The analysis was made by computing the transient current response for the system when current component $i_o$ flows, and then computing the transient response for such system when current component $i_1$ flows. The total transient current response is then obtained by superposition of both current components $i_o$ and $i_1$.

The voltage components $e_o$ and $e_1$ induced in primary winding $L_1$ were derived from the current component solutions. Such induced voltage components are shown in their composite form in FIG. 9 as voltage e across primary winding 61.

It should be noted that $e_1$ would be quite small if Q2 were not a Darlington transistor type, but is quite significant when Q2 is of the Darlington category.

With the foregoing in mind, and examining FIG. 6 summary of the mathematical functions, derived using reasonable approximations, equation (1), in intergo-differential form, represents the voltages added around the loop of current component $i_o$ as in FIG. 5 in accordance with Kirchoff's law. Likewise, equation (2) represents in integro-differential form the voltages added around the current loop $i_1$. Expressions (3) and (4) are the voltages $v_o(t)$ and $v_1(t)$ respectively and stated as a function of time.

To obtain the transient solution of equation (1), it was necessary to first transform equation (1) by Laplace methods to the complex domain from its time domain. In such complex domain the Laplace function was evaluated by solving the residues at the resultant poles of such transformation function. Such residues provide a retransformed function from the complex to the time domain and such function is stated by equation (5) which is the solution for the current component $i_o$. In the process of transformation and retransformation, certain approximations permitted neglecting the relatively insignificant frequency components so as to simplify the resultant expressions.

The transient solution of equation (2) for current $i_1$ resulting in equation (6), was made by a similar mathematical process.

Figure 7:
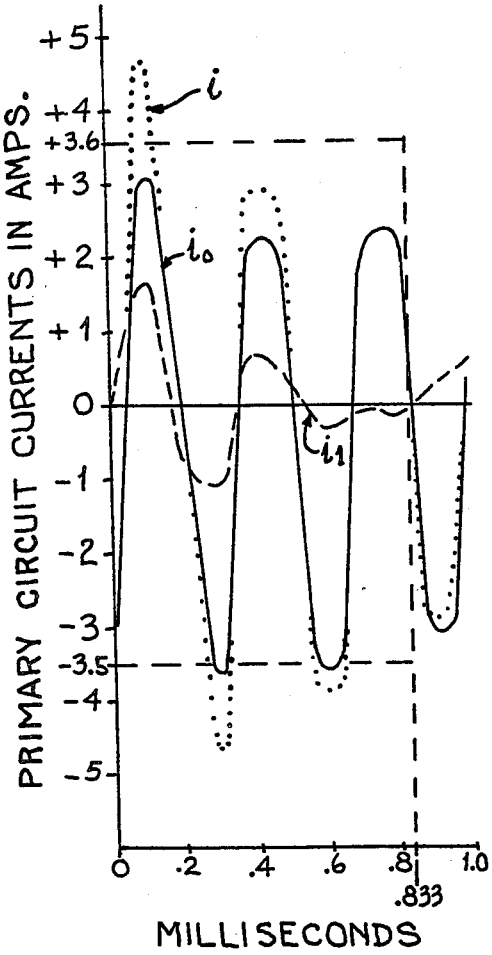
FIGS. 7 and 8 are respectively graphs of any primary circuit current and voltage components, constituting the results when the mathematical solutions are evaluated for applicable time periods.

The total current i, is the sum of the current components $i_o$ and $i_1$ and such total current is shown in FIG. 7 by the dotted line graph. Current i is significant for the igniter firing time period of 0.833 milliseconds, used herein in the computations.

The voltages induced in the primary winding, are by Faraday's law of induction, the negative of the total time derivative of the current multiplied by the effective inductance of such primary winding. The induced voltage component $e_o$ is obtained by differentiating equation (5) and multiplying the derivative obtained by $-L_1$. The expression for the voltage component $e_o$ is shown in equation (8) and such equation (8) is graphed for various values of time, up to one millisecond, in FIG. 8.

Figure 8:
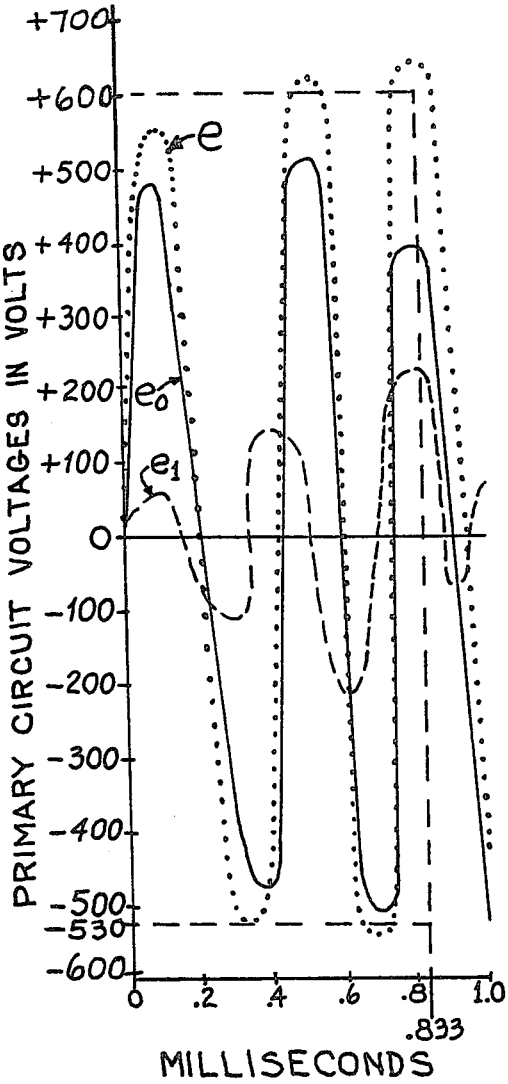

It can be seen from FIG. 8, that even with a Darlington Q2 circuit, the $e_1$ component will be relatively small compared to the $e_o$ component, but nontheless contributes to a higher voltage induced in the ignition transformer primary winding.

The sum of the voltage components, $e_o+e_1=e$, as stated by expression (10) is graphed in FIG. 8 as the dotted curve therein, and serves to show the increased induced voltage due to the presence of $e_1$ component.

Expressions (11) through (14) deal with theoretical instantaneous power and energy, obtained by making a graphic evaluation of the curves of FIGS. 7 and 8. The period of interest is our assumed firing period t of 0.833 milliseconds, and hence graphic integration of the current and voltage involved only such firing period. Such firing period yields the worst case condition and represents the lowest energy quantities delivered by this system.

The +3.6 ampere level and the −3.5 ampere level in FIG. 7 represent the average current swing for the total current i, which amounts to an average current swing of 7.1 amperes.

Figure 9:
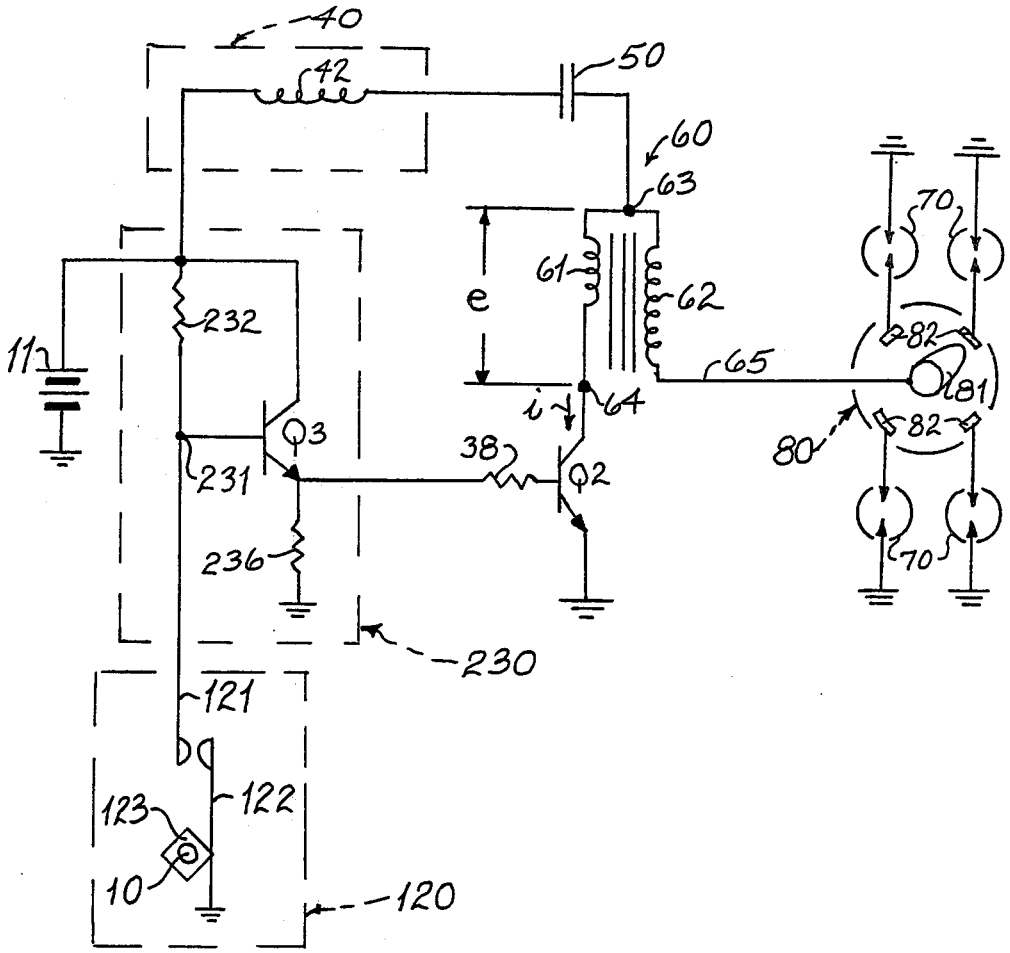
FIG. 9 is a circuit test set up in the laboratory with a typical conventional distributor, its purpose being solely to obtain and compare voltage and current waveforms during firing of an igniter and photograph oscilloscopic waveforms of such voltage and current.

Similarly the +600 volt and the −530 volt level in FIG. 9 represents the average voltage swing of 1130 volts.

Using the average current and voltage swings, expression (11) shows that the system, in its worst case mode, will develop 8023 watts of power.

The energy in the primary circuit will be a product of the computed instantaneous power multiplied by the firing period of t=0.833 milliseconds, and further multiplied by the duty cycle factor of the AC power source. Such duty cycle, T, being 0.5, since when one of the transistors in the AC power source is on the other is off. The square of such duty cycle is used to account for such duty cycle in both the voltage and current waves of such AC power source. Accordingly, the primary winding energy level of 1.67 watt-seconds was computed in expression (12).

The energy level in the secondary circuit of the ignition transformer and consequently the igniter firing energy may be obtained by taking into consideration the transfer efficiency of the ignition transformer. Accordingly, for an efficiency factor of 0.9, expression (13) indicates an igniter fire energy of 1.5 watt-seconds.

It is now possible to compare the effectiveness of the inventive system with a conventional Kettering system. The Kettering system, according to computations made elsewhere, delivers an energy level of $0.936\times10^{-2}$ watt-seconds to an igniter. Hence the theoretical advantage of this system N, may be measured as a ratio of this system's igniter firing energy over that of the Kettering system. Such computation at (14) shows an energy advantage over the Kettering system of 160 or 16,000 percent.

Referring to FIG. 9, for convenience of obtaining correlation with the theoretical computations, above, a pair of conventional contactors 121–122 driven by cam 123 which coupled to a distributor shaft 10 of a conventional arcing type high voltage distributor 80, was used as a timer 120 to activate logic circuit 230 intermittently.

Logic circuit 230 is identical to the one discussed in connection with FIG. 2. Similarly, AC power source 40 is identical to the one used in any of the foregoing configurations, the output of which is shown connected to battery 11 on one side and to capacitor 50 on the other side of the transformer output winding 42. An ignition transformer 60 was connected to capacitor 50 in identical manner as used in FIGS. 1 or 2 configurations, and switch Q2 is shown in identical connection as is used in conjunction with any of the configurations in primary winding 61 circuit.

The output of the secondary winding 62 however was connected to distributor switch arm 81 of such conventional distributor 80, and igniters 70 of the type illustrated in FIG. 14, were connected to members 82 of the distributor. Since the purpose of this experimental set up was to measure and observe the oscilloscopic waveforms e and i, and correlate same with the theoretical values obtained, the use of distributor 80, shaft 10 of which was used to drive distributor rotor 81, was convenient without needlessly multiplying the number of logic circuits and ignition transformers as well as building special timers in order to duplicate any of the configurations of FIGS. 1–4, which for the purpose stated above, the FIG. 9 laboratory set up provided the same results in terms of voltage and current performance waveforms.

The results measured under two different types of Q2 switches are:

| Parameter | Non-Darlington Q2, 2N6251 or 2N6547 | Darlington Q2, MJ 10005 - Motorola |
|---|---|---|
| 1 (peak-to-peak) | 8.33 amperes | 12.5 amperes |
| o (peak-to-peak) | 1200 volts | 1330 volts |
| P = ie | 9996 watts | 16,625 watts |
| $E_{primary}$(t = .833 ms. and T = .5) | 2.08 watt-seconds | 3.46 watt-seconds |
| $E_{igniter}$ | 1.87 watt-seconds | 3.12 watt-seconds |
| $N = \frac{E_{igniter}}{E_{Kettering}}$ | 200 | 333 |

The foregoing results show correlation with the magitudes of voltage and current levels approximated by the computations, but actually higher voltage, current and power and energy levels were obtained than were computed. Such differences can be easily accounted for by virtue of neglecting higher order and lower amplitude frequency components in the computations in oder to simplify such computation process. Here, the difference between the use of Darlington Q2 switch and a non-Darlington switch becomes evident in terms of the increased voltage, current, power and energy levels.

The results obtained show the current and voltage ignition pattern from igniter firings to run together without discrete spacings therebetween when Q2 is removed from its socket, to indicate that there is residual energy stored in the coupling transformer of the AC power source and transfer of such residual energy to the ignition transformer primary after the timer of the system and its logic circuit in operation has biased the Q's of the AC source to their non-conducting states. Such residual energy is cut off by Q2 control simultaneously with deactivation of the AC source, as hereinabove explained, the Q2 serving to inhibit current flowing, due to residual energy in the coupling transformer, at the end of each igniter firing period.

A comparison with a conventional Kettering system, utilizing an igniter of conventional type with its spark gap setting in accordance with automtive manufacturer's specification, may be made with the performance of an igniter in the inventive system. The conventional Kettering system was set up in the laboratory with a driven conventional distributor similar to the laboratory set up for the inventive system as discussed above. The difference in performance between the Kettering system, as photographed, with the inventive system in terms of arc are coverage and energy delivered to ignite the engine fuel, is rather startling, and self evident from the results obtained.

What is claimed is:

1. A distributorless ignition system comprising the combination of:

a power source having output means for providing alternating current;

a capacitor in series with said output means;

a plural number of primary circuits comprising a plural number of transformer windings connected to said capacitor and output means, said capacitor, output means and one of the transformer windings comprising one primary circuit; and switching means, coupled to said primary circuits, one of said switching means per one said primary circuit, said alternating current power source also being means for enabling current conduction to take place through said switching means.

2. The invention as stated in claim 1, wherein said switching means comprises a plural number of electronic switches and wherein only one of said electronic switches conducts current during any one time interval, all other of said electronic switches being quiescent during said any one time interval.

3. The invention as stated in claim 1, including logic means coupled to said switching means for activating said switching means, only one of said logic means activating a corresponding one of said switching means.

4. The invention as stated in claim 1, including:

logic means, coupled to said power source and to said switching means, for substantially simultaneously providing bias to the power source and switching means; and trigger means, coupled to the logic means, for intermittently activating said logic means.

5. The invention as stated in claim 1, wherein said switching means increases the energy levels in said transformer windings.

6. The invention as stated in claim 1, wherein said switching means increases the voltage levels induced in said transformer windings and amplifies the currents flowing in said transformer windings.

7. The invention as stated in claim 1, wherein said switching means comprises Darlington circuits.

8. The invention as stated in claim 1, wherein said power source has oscillatory stages and wherein said oscillatory stages comprise Darlington circuits.

9. The invention as stated in claim 1, wherein said switching means intermittently provides energy which intermodulates with the alternating current in said transformer windings.

10. The invention as stated in claim 1, wherein said primary circuit alters excursion uniformity of the waveform of alternating current.

11. The invention as stated in claim 1, wherein said switching means provide discrete separation between successive ignition voltage and current waveforms in successive firing cycles of the system.

12. The invention as stated in claim 1, wherein said power source generates an output waveform at said output means for each ignition cycle, said output waveform comprising a plural number of excursions of substantially uniform intervals therebetween.

13. The invention as stated in claim 1, wherein said one of said switching means enables current to flow through its corresponding one of the primary circuits, all other of said switching means inhibiting current conduction through all other of the primary circuits during any one time interval.

14. The invention as stated in claim 3, including trigger means, coupled to said logic means, for initiating said logic means.

15. The invention as stated in claim 8, including logic means coupled to said Darlington circuits for intermittently providing bias to said Darlington circuits.

16. The invention as stated in claim 14, wherein said trigger means comprises a pulse generating magnetic timer.

17. The invention as stated in claim 14, wherein said trigger means comprises an electrically conductive disk having an insulative member at the periphery of the disk within the confines of said disk, and a plural number of contactors, in cooperation with said periphery, connected to said logic means, one of said contactors per one of said logic means.

18. The invention as stated in claim 14, wherein said trigger means comprises a disk having an aperture at the periphery of the disk and illumination means at one face of said disk for optically intermittently illuminating said logic means through said aperture.

19. The invention as stated in claim 14, wherein said trigger means comprises a plural number of modulated oscillators coupled to said logic means, one of said oscillators per one of said logic means.

* * * * *